United States Patent [19]

Ferree

[11] 4,057,225

[45] Nov. 8, 1977

[54] SCREW FEEDER FOR GRANULAR MATERIAL

[75] Inventor: Roy E. Ferree, Valencia, Pa.

[73] Assignee: ESM Inc., Valencia, Pa.

[21] Appl. No.: 705,091

[22] Filed: July 14, 1976

[51] Int. Cl.[2] ..... B01F 9/08; B01F 15/02

[52] U.S. Cl. ..... 366/157; 198/658; 222/413; 366/224

[58] Field of Search ..... 259/3, 14, 15, 16, 84, 259/85, 105, 31, 32, 33, 58; 222/413; 198/213, 214, 658, 670, 677

[56] References Cited

U.S. PATENT DOCUMENTS

| | | | |
|---|---|---|---|
| 2,989,291 | 6/1961 | Bedner | 259/3 |
| 3,020,028 | 2/1962 | Bullock | 259/3 |
| 3,245,110 | 4/1966 | Daubenfeld | 259/3 |
| 3,387,828 | 6/1968 | Bosche | 259/85 |
| 3,704,076 | 11/1972 | Bodunov | 222/413 |

*Primary Examiner*—Robert W. Jenkins
*Attorney, Agent, or Firm*—William J. Ruano

[57] ABSTRACT

A screw feeder comprising a pair of augers of different diameters, coaxially and co-extensively arranged, which are driven by separate motors, one of which drives a mixing drum and auger of larger diameter, and the other drives the auger of smaller diameter. By rotating the outer auger at the slower speed of the drum and the inner auger at a higher speed, the particles or granular material fed to the augers will be thoroughly and uniformly mixed as well as propelled outwardly of the feed bin by screw feed action.

3 Claims, 3 Drawing Figures

SCREW FEEDER FOR GRANULAR MATERIAL

This invention relates to feeding apparatus for granular or particulate material and, more particularly, relates to a feed drive for thoroughly and uniformly mixing the material and feeding it outwardly of a bin by augers.

An outstanding disadvantage of feeding apparatus for such material as used in the past is the complication of the feed screw drive; often involving the necessity of gear boxes for rotating a pair of augers or feed screws at a particular relative speed and the difficulty involved in changing such relative speed.

An object of the present invention is to provide a novel feeding apparatus for granular or particulate material, which apparatus overcomes the abovenamed disadvantages of prior devices and which involves considerably less operating parts, yet which gives greater flexibility and more uniform mixing and density of particulate material fed into a bin.

Other objects and advantages will become apparent from a study of the specifications taken with the accompanying drawing wherein.

Figure 1:
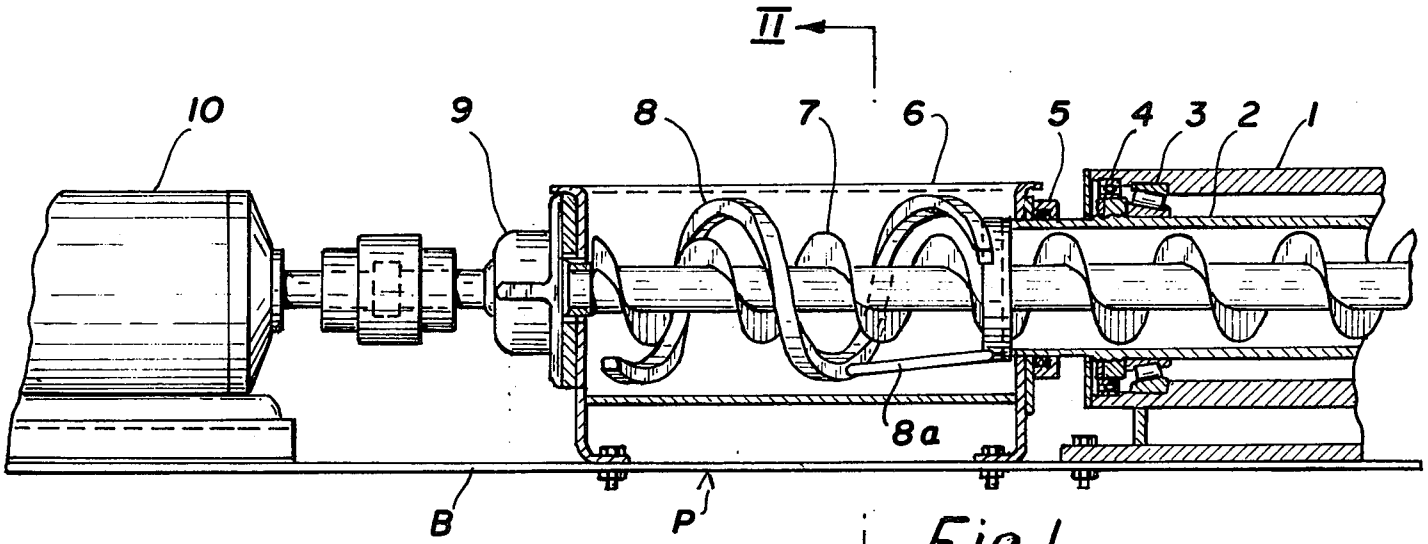
FIG. 1 is an elevational view, partly in vertical cross-section, showing the feed screw drive embodying the present invention.
Figure 2:
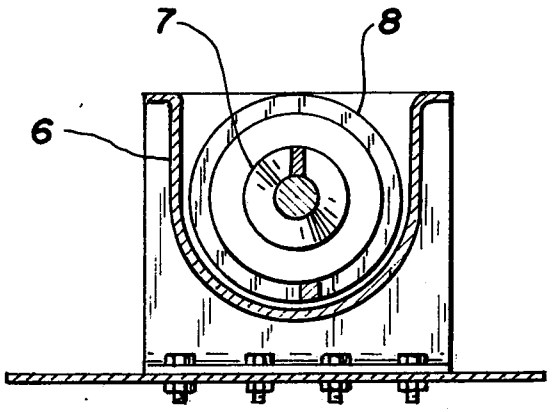
FIG. 2 is a cross-sectional view taken along line 2—2 of FIG. 1.

Referring more particularly to FIGS. 1 and 2 of the drawing, numeral 1 denotes a fixed bearing housing in which is contained, in coaxial relationship, a rotating screw housing 2 which is rotatably mounted in housing 1 by a screw housing bearing assembly 3. The housings 1 and 2 are sealed at their ends by screw housing bearing seal assemblies 4.

A feed chamber seal assembly 5 is provided at an end of feed chamber 6 into which granular or particulate material is fed from the top thereof. A feeder screw or inner auger 7 extends through both the feed chamber 6 and rotating screw housing 2, journaled by a feeder screw bearing 9 and being driven by a feeder screw variable speed drive unit 10.

Figure 3:
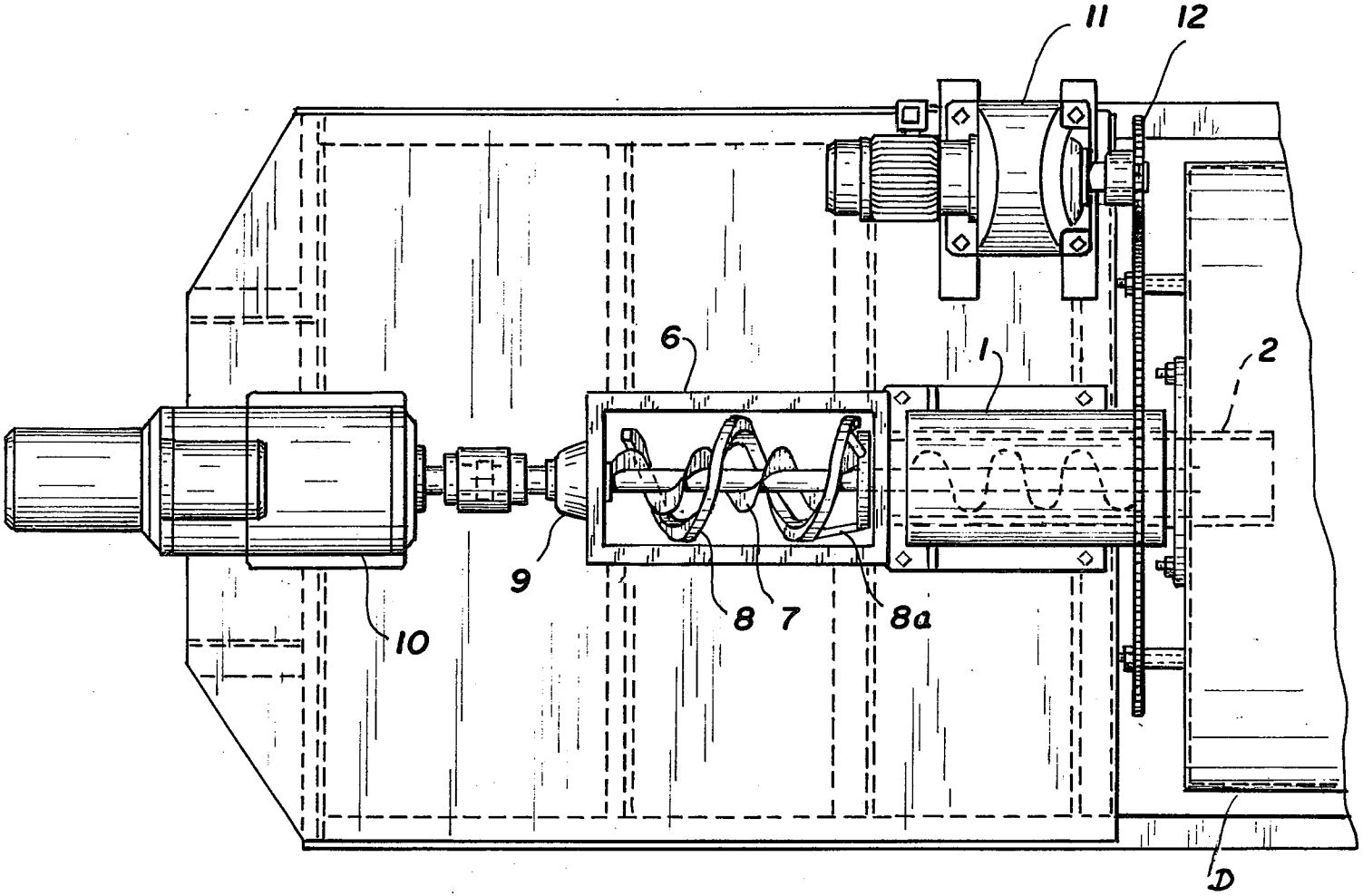
FIG. 3 is a top or plan view of the entire assembly including a rotated drum and which includes the drive shown in FIGS. 1 and 2.

An outer auger or intromitter 8 is provided inside feed chamber 6 in the form of a helical spiral, preferably spiralled in the same direction as the inner auger 7, although in some cases it may be spiralled in an opposite direction. One end of the outer auger 8 is rigidly secured to the end of rotating screw housing 2 which, in turn, is driven by a drum D as shown in FIG. 3. Connecting stud 8*a* may be used.

FIG. 2 shows the preferable direction of drive, as indicated by the arrows, that is, in the same direction. However, the inner auger 7 is driven at a substantially greater speed than the outer auger 8.

Such outer auger 8, upon rotation at a greater speed than inner auger 7, causes an inward and outward radial force to be developed. The inward radial force provides a uniform density of the particles and simultaneously fills the inner auger 7. The outer radial force provides eruption to the particles to eliminate any possibility of void spaces in the particles, thereby insuring uninterrupted gravity flow of the particles into the augers.

FIG. 3 shows more clearly the drum D which is rigidly secured to the rotating screw housing 2 which, in turn, is rigidly secured to the outer auger 8.

The drum D is driven by a drive unit 11 which drives a sprocket 12 of a chain drive for rotating the drum at a slower speed than that of the drive shaft of unit 11. Thus the drum and the outer auger 8 rotate at the same speed, which is substantially lower than that of the speed of inner auger 7.

While the base B for the feeding apparatus may be normally horizontal, as shown in FIGS. 1 and 2, in some situations it is desirable to pivot the base on a pivot P (FIG. 1) and, by power amplifying means (not shown) lift the section supporting the drum at variable and selective heights so as to tip the drum at selective angles relative to the floor on which the apparatus is supported.

Thus it will be seen that I have provided an efficient screw feeding apparatus for granular or particulate matter embodying coaxially disposed augers which are co-extensive in length inside a feeder bin and in which the auger of larger diameter is rigidly secured to a rotating drum driven by separate means than the drive for the inner auger to enable selectively variable relative speeds of the augers; also I have provided a simple and inexpensive as well as fewer parts in the feeder apparatus and at the same time much greater flexibility in changing the relative speeds of the augers to accomodate different materials and sizes of particulate matter so as to insure uniform density, caused by thorough mixing, and elimination of voids in the mass of particles being fed by the augers.

While I have illustrated and described a single specific embodiment of my invention, it will be understood that this is by way of illustration only and that various changes and modifications may be contemplated in my invention and within the scope of the following claims.

I claim:

1. A screw feeding apparatus for particulate matter, comprising a feed chamber in which is mounted a pair of concentric augers which are substantially co-extensive in length, variable speed drive means for driving the inner auger of smaller diameter, a rotating housing rigidly connected, at one end, to the outer auger of greater diameter and surrounding a portion of the inner auger, a drum rigidly connected at the other end of said rotating housing, and a separate driving means for driving said drum about its axis.

2. The screw feeding apparatus recited in claim 1 together with a stationary housing surrounding said rotating housing and which sealed at least one end thereto, and wherein said last named driving means is driven by a variable speed motor through a chain drive for reducing the speed of said drum.

3. Apparatus as recited in claim 1 wherein said outer auger is of rectangular cross-section and wherein said means for attaching said outer auger to one end of said rotating drum includes a stud bridging about one turn of said outer auger.

* * * * *